US005631438A

United States Patent [19]

Martel

[11] Patent Number: 5,631,438

[45] Date of Patent: May 20, 1997

[54] ADJUSTABLE GAS PRESSURE DEFLECTOR

[76] Inventor: Phillip C. Martel, 43551 Applewood, Canton, Mich. 48188

[21] Appl. No.: 423,764

[22] Filed: Apr. 17, 1995

[51] Int. Cl.[6] ..... F41A 21/00

[52] U.S. Cl. ..... 89/14.3; 89/14.2; 42/79

[58] Field of Search ..... 42/79; 89/14.2, 89/14.3

[56] References Cited

U.S. PATENT DOCUMENTS

| | | | |
|---|---|---|---|
| 618,901 | 2/1899 | Peterson | 89/14.3 |
| 2,191,484 | 2/1940 | Hughes | 89/14.3 |
| 2,453,121 | 4/1948 | Cutts | 89/14 |
| 2,567,826 | 5/1951 | Prache | 89/14 |
| 3,707,899 | 1/1973 | Perrine | 89/14 C |
| 3,714,864 | 2/1973 | Thierry | 89/14.3 |
| 4,307,652 | 12/1981 | Witt et al. | 89/14 C |
| 4,930,397 | 6/1990 | Seidler | 89/14.3 |
| 5,020,416 | 6/1991 | Tripp | 89/14.3 |
| 5,036,747 | 8/1991 | McClain, III | 89/14.3 |
| 5,063,827 | 11/1991 | Williamson | 89/14.3 |
| 5,249,385 | 10/1993 | Vang et al. | 42/79 |
| 5,305,677 | 4/1994 | Kleinguenther et al. | 89/14.2 |

FOREIGN PATENT DOCUMENTS

| | | | |
|---|---|---|---|
| 4690 | 2/1897 | Germany . | |
| 4690 | 12/1896 | United Kingdom | 89/14.3 |

OTHER PUBLICATIONS

OG Abstract – Sep. 26, 1989 4,869,151.
OG Abstract – Jun. 5, 1990 4,930,396.
American Rifleman Magazine – 1994.
Outdoor Marketplace – Sep. 1994.
"World's Finest" Recoil Reduction System.

*Primary Examiner*—Charles T. Jordon
*Assistant Examiner*—Meena Chelliah
*Attorney, Agent, or Firm*—Young & Basile, P.C.

[57] ABSTRACT

A gas pressure deflector system mounted on the exterior of a muzzle brake for a firearm barrel. The gas pressure deflector system comprises two deflectors adjustably positioned along the longitudinal axis of the brake to bracket the muzzle brake vent apertures. The deflectors create a pressure equalizing trap serving to smooth out the pressure pulse differential occurring along the muzzle brake gas venting region when a bullet is fired, thereby enhancing bullet accuracy and reducing recoil.

23 Claims, 3 Drawing Sheets

ADJUSTABLE GAS PRESSURE DEFLECTOR

FIELD OF THE INVENTION

This invention relates generally to a device for improving the accuracy of firearms and other projectile launchers, and more specifically to a device used in combination with a muzzle brake to control the escape of pressurized gas therefrom.

BACKGROUND OF THE INVENTION

Muzzle brakes have been used for many years to reduce recoil and improve the accuracy of firearms such as pistols, rifles, shotguns and artillery pieces. A muzzle brake is a portion of the gun barrel, or an extension of the barrel, which is provided with one or more (usually several) holes or vent apertures passing radially through the wall of the muzzle brake. If the muzzle brake is an integral part of the barrel, the apertures are typically located at or near the muzzle. If the brake is an attachment or extension of the barrel, usually a tubular body with a bore greater than the bore of the barrel, it is typically attached to the barrel at or near the muzzle. As used herein, the term "muzzle brake" shall generally refer to both integral and attached brakes. The term "muzzle brake" as used herein also includes devices such as "flash suppressors/hiders" and "compensators" to the extent they produce an elongated pattern of radially vented gas.

As a bullet or projectile travels down the firearm barrel after firing, the vent apertures allow the compressed air being pushed ahead of the bullet to escape from the muzzle brake in a lateral direction before the bullet reaches the apertures. Likewise, the vent apertures allow the high pressure combustion gas propelling the bullet to escape from the muzzle brake in a radial direction after the bullet has passed the vent apertures but before it exits the muzzle brake. By providing a decrease in the pressure of the gas both in front of and behind the projectile before it exits the muzzle brake, the recoil forces which accompany the firing of a gun are reduced. Muzzle brakes can also improve accuracy by decreasing the destabilizing effect which the high pressure gas has on the projectile immediately after it exits the muzzle.

A muzzle brake may be formed integrally with a gun barrel by drilling or otherwise forming vent apertures in the barrel itself. To achieve the greatest reduction and recoil, such brakes are most commonly formed at or near the muzzle of the gun barrel. However, brakes are sometimes formed at positions more rearwardly on the barrel. Alternatively, a muzzle brake may be fabricated as a unit separate from the gun barrel and attached thereto over the muzzle end to form an extension of the barrel. Muzzle brakes of this type are commonly attached to a gun barrel, for example, by cooperating threads formed on the inside of the muzzle brake and the outside of the barrel.

Most muzzle brakes employ an axial array of vent apertures, i.e., multiple axially spaced apertures or sets of apertures, or a single set of axially elongated apertures. This results in an elongated pattern of radially vented gas with different pressure characteristics from the rearward to the forward regions of the muzzle brake.

It has been found that a muzzle brake provides greater recoil reduction and accuracy improvement if the gas pressures in front of and behind the projectile are allowed to decrease uniformly over the length of the brake as the projectile approaches and passes therethrough. U.S. Pat. Nos. 4,930,396, issued Jun. 5, 1990 and 5,305,677, issued Apr. 26, 1994 both teach muzzle brakes which attempt to regulate the amount of pressure drop taking place along the length of the brake by varying the diameter of its internal bore. In the '396 patent the muzzle brake has an internal bore comprising several conical sections of varying size and configurations, while the brake of the '677 patent features several cylindrical bore sections which decrease in diameter toward the forward end of the brake.

Muzzle brakes are known to increase noise to the shooter, the result of the radial re-direction of gas upon firing. Some known muzzle brakes feature externally mounted blast deflectors which shield the shooter from some of this noise. In U.S. Pat. No. 5,063,827 issued Nov. 12, 1991 a blast deflector is fitted to the extreme rear end of a muzzle brake, where it attaches to the gun barrel. This blast deflector has an angled or concave surface facing the forward or muzzle end of the brake and is intended to deflect the combustion gases and sonic waves associated therewith forward away from the shooter. The deflector has no beneficial effect in terms of recoil reduction or improved accuracy, but rather is intended solely to decrease the annoying and possibly ear-damaging effects of the muzzle blast.

A muzzle brake disclosed in U.S. Pat. No. 4,869,151 attempts to reduce recoil as well as suppress noise. It features a plurality of apertures which angle forward as they pass from the interior bore to the surface of the muzzle brake. An annular rib is located immediately behind the vent apertures to partially shield the shooter from sound waves exiting therefrom.

U.S. Pat. No. 5,036,747 teaches a muzzle brake having forward slanting apertures which direct the gases escaping from the bore onto rearward sloping circumferential skirts. The impingement of gases on the skirts causes a forward thrust on the muzzle brake and hence the rifle barrel, the thrust tending to counteract recoil. The skirts also define plenum chambers which act to restrain the gases inside the muzzle brake for a pressure metering effect.

Muzzle brakes can also have an impact on gun accuracy by affecting barrel harmonics. The barrel of a firearm has a number of natural vibrational frequencies, or harmonics, one or more of which may be excited by firing of the weapon. Most gun barrels are stiff and highly damped, but harmonic vibrations cannot be completely eliminated and the muzzle of the barrel may still deflect enough upon firing to spoil the gun's accuracy.

The exact effect of barrel harmonic vibrations on projectile accuracy is difficult to predict, especially as it depends on the cartridge being fired, i.e., the weight of the projectile and the amount of propellant providing the thrust, as well as the weight and size of the barrel. This has led to the advent of muzzle brakes that are adjustable, allowing the shooter to close and open some of the vent apertures or to move the muzzle brake forward and rearward with respect to the barrel. This creates small changes in the barrel harmonics, and the shooter may use trial-and-error testing to find a muzzle brake setting that provides the best accuracy for a given rifle and cartridge combination. Examples of adjustable muzzle brakes are the BOSS System sold by Browning and the Adjustable Muzzle Brake sold by Que Industries.

SUMMARY OF THE INVENTION

It is an object of the present invention to provide a gas pressure deflector system which is located on the exterior of a muzzle brake to improve projectile accuracy. This is achieved by controlling the gas pressure along a lengthwise portion of the muzzle brake between rearward and forward regions of gas venting. The gas pressure deflector system forms a pressure-equalizing trap across the apertures and so affects the differential pressure pulse which occurs along the muzzle brake when a projectile and the high pressure gases preceding and following it pass through the muzzle brake. In general this is achieved with a gas pressure deflector system comprising a pair of opposed deflectors, one located forwardly on the muzzle brake and the other located rearwardly on the muzzle brake. The deflectors have opposing deflector surfaces to create an enclosing effect which is believed to equalize the pressure distribution around the muzzle brake between the deflectors.

It is another object of the present invention to provide an adjustable gas pressure deflector system to provide the shooter with a fine tuning capability. This is generally achieved in the present invention by mounting at least one of the deflectors to be adjustable along the length of the muzzle brake. This allows the shooter, by a trial-and-error process, to locate the deflectors at the relative positions and spacing which provide maximum accuracy for a particular firearm/cartridge combination.

It is still another object of the present invention to provide a simple, inexpensive gas pressure deflector that may be added onto an existing non-adjustable muzzle brake and thereby provide a means for adjusting the brake.

It is yet another object of the present invention to provide a gas pressure deflector that may be added onto an existing adjustable muzzle brake and thereby provide an additional degree of adjustability to further enhance accuracy.

It is another object of the invention to provide a gas pressure deflector that works with virtually any pattern of vent apertures or directional gas venting from the brake to improve accuracy.

DESCRIPTION OF THE PREFERRED EMBODIMENT

Figure 1:
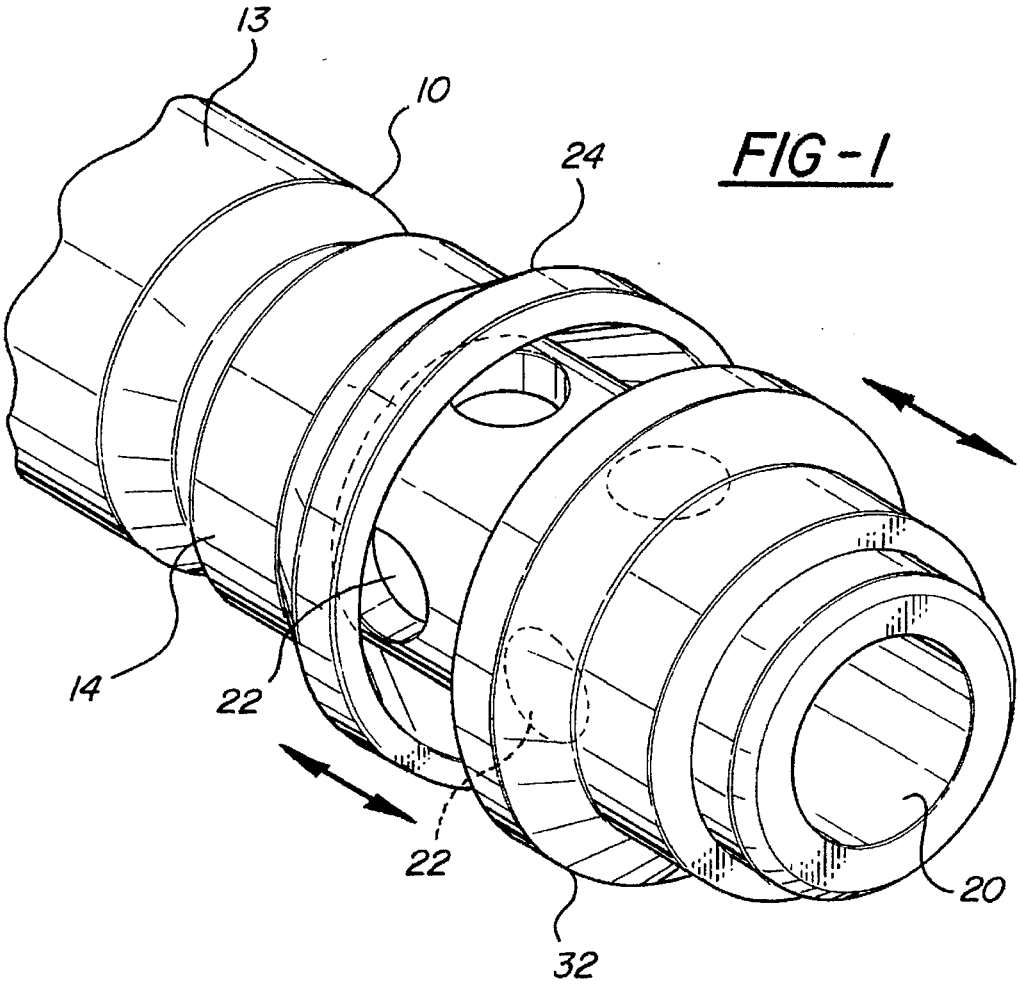
FIG. 1 is an end perspective view of a gas pressure deflector according to the present invention mounted on a muzzle brake.
Figure 2:
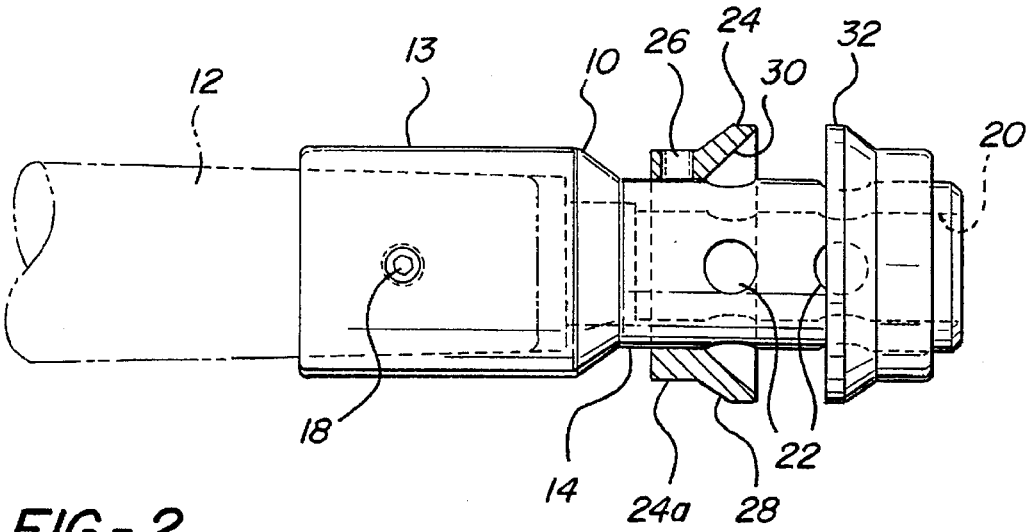
FIG. 2 is a side view of the gas pressure deflector and muzzle brake depicted in FIG. 1, illustrating the muzzle brake as the type attached to the end of a gun barrel.

FIGS. 1 and 2 depict the present invention in combination with a muzzle brake 10 mounted to the muzzle end of a gun barrel 12. Muzzle brake 10 represents a generic muzzle brake of the type which is fabricated separately from the gun barrel and attached for use on small arms such as rifles and pistols, although the following description is not intended to limit the present invention to use on any particular type of muzzle brake or firearm.

Muzzle brake 10 consists of two main portions: a barrel mating section 13 and a pressure relief or gas venting section 14. Barrel mating section 13 fits over the end of the gun barrel 12 and is held firmly in place by a set screw 18. Muzzle brake 10 can be secured to barrel 12 in alternate manner, for example via mating threads formed on the muzzle brake and gun barrel, or by other suitable methods known to those skilled in the art.

Muzzle brake 10 includes a pressure relief section 14 of generally tubular shape and having an internal bore 20 of a diameter at least slightly larger than the bore of gun barrel 12. Where the brake is an integral vented section of the barrel, the bore of the brake may be the same as that of the barrel. The wall of pressure relief section 14 is perforated by two axially spaced sets of vent apertures 22 which provide passages through which high pressure gases are radially vented when the firearm is fired. The illustrated vent apertures 22 are, as in many commercially available muzzle brakes, distributed substantially evenly around the circumference of muzzle brake 10 so that an increase of pressure within bore 20 vents freely in all radial directions. However, the present invention can also be used with muzzle brakes having unevenly distributed vent apertures, as well as with those featuring vent apertures formed as slots or other shapes. The present invention is also useful with muzzle brakes having vent apertures formed at an oblique angle with the barrel axis and which therefore direct the venting gases somewhat forwardly or rearwardly.

The pressure relief section 14 includes a gas venting region approximately defined by the axial or lengthwise spacing of the vent apertures, i.e., the axial distance from the rearward most vent aperture to the forward most vent aperture. Gas is successively vented radially from the rearward and then forward sets of apertures across this region.

A first or rear deflector 24 is located on pressure relief section 14 at a position behind the rearward vent apertures 22. Deflector 24 in the illustrated embodiment is formed from a single piece of strong, heat resistant metal such as steel. It includes a cylindrical sleeve 24*a* which mates closely with the muzzle brake in a sliding fit. Deflector 24 can therefore be slidingly adjusted along muzzle brake section 14 until located at a desired position relative to a rearward portion of the gas venting region, here the rearward set of vent apertures. Deflector 24 is then axially locked to the muzzle brake with easily-operated fastening structure. In the illustrated embodiment rear deflector 24 is held in position by a set screw 26, although other means of attachment known in the gunsmithing art may also be used.

Figure 3:
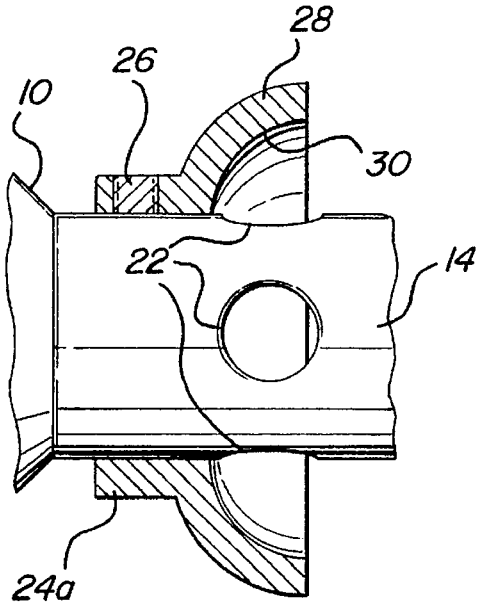
FIG. 3 is a side section view of an alternative embodiment of a deflector according to the present invention, having a concave deflector surface.
Figure 4:
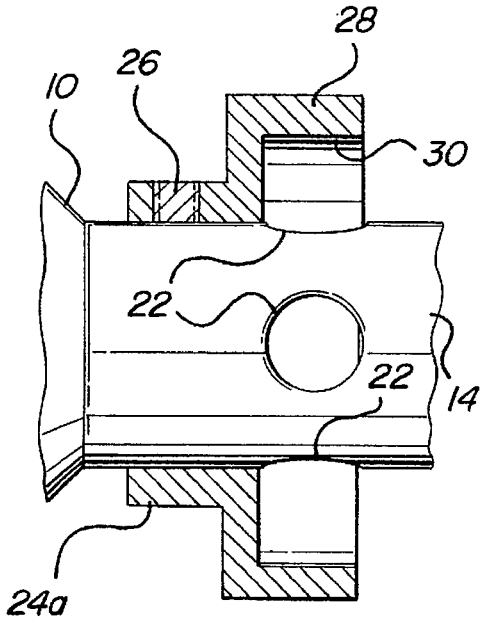
FIG. 4 is a section view of still another embodiment of a deflector according to the present invention, having a right angled deflector surface.

Rear deflector 24 also includes a flared portion 28 which extends radially outward from the surface of muzzle brake 10 and simultaneously in a forward direction to form an angled deflector surface 30. Deflector surface 30 can be a flat, conical surface as shown in FIG. 2, or can be of other geometries which extend forward to partially cover or enclose and deflect gas from a vented portion of pressure relief section 14. For example, deflector surface 30 can be a curved surface as shown in FIG. 3 or a right-angled (cylindrical) configuration as shown in FIG. 4.

A forward deflector 32 is substantially identical to rear deflector 24 but is adjustably positioned on the muzzle brake in a rearward facing manner to oppose rear deflector 24. Forward deflector 32 is secured to pressure relief section 14 in association with a forward portion of the gas venting region, here one or more forward vent apertures 22 so that its deflector surface partially covers a vented portion of the muzzle brake, for example the vent apertures 22 as illustrated. For pressure uniformity and manufacturing economy considerations it is preferred, although not necessary, to produce rear and forward deflectors 24, 32 as identical pieces.

The adjustable nature of one or both of deflectors 24, 32 via means such as the illustrated sliding fit and set screw 26 allows the user to adjust the location of the deflectors relative to the gun barrel for harmonics improvement, and further to adjust the extent of the vented portion 14 of the muzzle brake across which the deflectors affect pressure. It is preferred, although not necessary, that both deflectors 24, 32 be adjustable. It will be understood that other means of lengthwise adjustment are possible, although the illustrated sliding fit is preferred.

While the deflectors 24, 32 have been illustrated in use with a muzzle brake having multiple sets of separate, axially spaced forward and rearward vent apertures, they are equally useful in association with rearward and forward regions of axially elongated vent apertures. For example, flash/recoil suppressors of the type on M-14 style rifles (schematically illustrated in FIG. 8) consist of a circumferentially, spaced series of elongated, slit-type vent apertures 22. There are no separate "forward" and "rearward" sets of apertures; however, deflectors 24, 32 can be located on respectively rearward and forward regions of the slits to achieve similar results.

Figure 6:
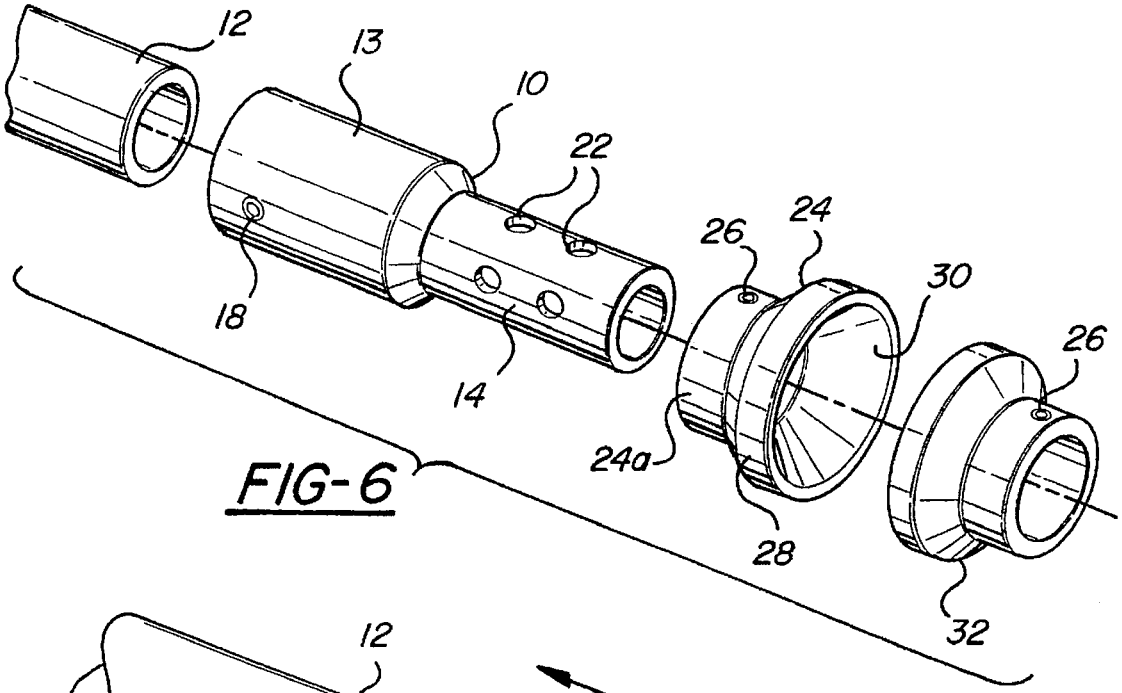
FIG. 6 is an exploded perspective view of the gas pressure deflector and muzzle brake of FIG. 1; and, FIG. 7 illustrates a gas pressure deflector according to FIG. 6, mounted on an alternate type of muzzle brake.

FIG. 6 illustrates the assembly relationship between muzzle brake 10 and deflectors 24, 32. Installation and removal of the deflectors is a simple matter of slide fit and set screw tightening. It will be apparent that deflectors 24, 32 can be machined to fit and function with virtually any diameter muzzle brake.

Figure 7:
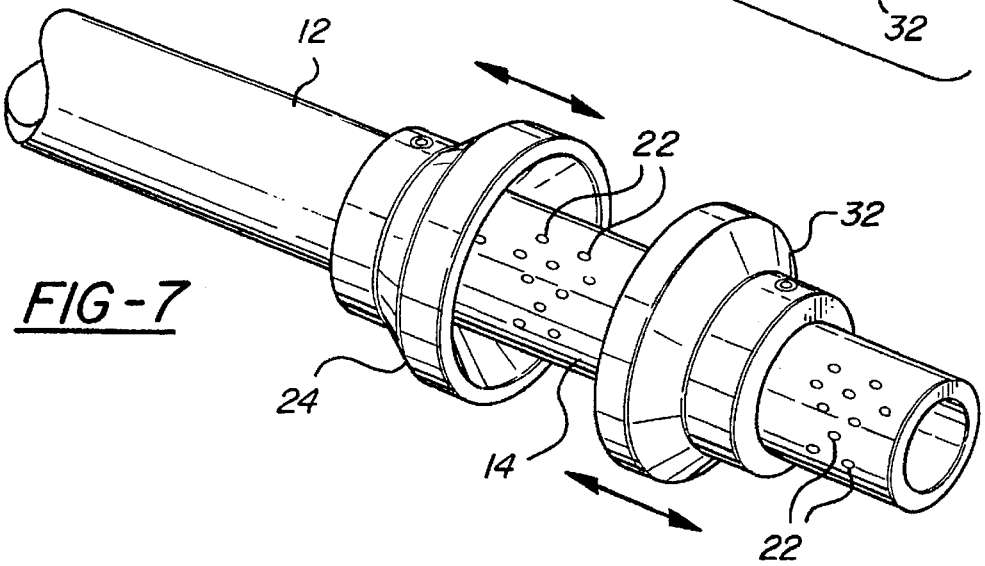
Figure 8:
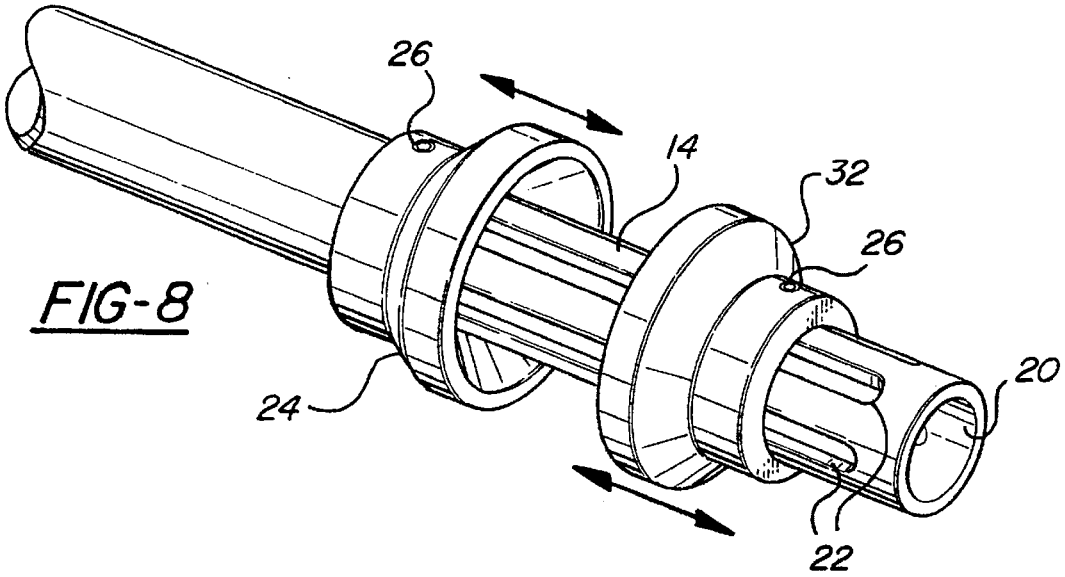
FIG. 8 illustrates a gas pressure deflector according to FIG. 6, mounted on a further alternate type of muzzle brake.

FIGS. 7 and 8 schematically illustrate two of the many alternate styles or patterns of vent apertures with which the inventive deflector system can be used. It should be noted that the placement of rear deflector 24 behind the rearwardmost set or portion of vent apertures 22, illustrated in FIGS. 1–5 and 8, is preferred.

OPERATION

As a projectile travels down barrel 12 and approaches muzzle brake 10, it pushes ahead of it the air that was present in barrel 12 before firing. The pulse of increased air pressure thus caused reaches the rearmost of vent apertures 22 first and begins venting through them before reaching the more forwardly located apertures. Since the air pressure pulse inside the muzzle brake begins to bleed off through the rear apertures, there is less pressure to be released through the more forward apertures. The result, in the absence of a gas pressure deflector system according to the present invention, is that the pressure vented through the apertures drops off sharply along the length of the brake.

The same decreasing rear-to-front pressure pulse sequence occurs with regards to the combustion gases behind the projectile. As the bullet passes each set of vent apertures 22 the combustion gases propelling it are vented first through the rearmost apertures, followed in succession by those further forward on muzzle brake 10. The largest pressure drop occurs through the rear apertures, with successively lower pressure drops through the forward apertures. The effect is similar across the length of elongated apertures of the type shown in FIG. 8.

The positioning of front and rear deflectors 24, 32 in a spaced, opposing relationship bracketing and partially enclosing the gas venting region defined by vent apertures 22 results in the formation of a "pressure trap" in the area adjacent the exterior surface of muzzle brake 10 between the deflectors. As gases first begin to exit the rearmost vent apertures they encounter deflector surface 30 of rear deflector 24 and are redirected forwardly toward deflector 32; gas exiting the forward vent apertures is redirected rearwardly by deflector 32. The opposing orientation of deflector surfaces 30, 34 redirects and partially contains the gases in the volume defined between the deflectors and surrounding muzzle brake surface 22 during the approximately 20 to 40 microseconds required for the projectile to travel through and out of muzzle brake 10, thereby causing a back pressure experienced by all of vent apertures 22 located between the deflectors. In this pressure trap the uneven pressure pulse vented through apertures 22 as a projectile transits the muzzle brake is smoothed out or equalized along the brake. This more even and gradual relief of pressure results in better projectile accuracy.

In some muzzle brakes, some or all of the vent apertures are formed at oblique angles with the axis of the barrel in order to vent gases forwardly and/or rearwardly along the barrel. In such cases, gas pressure venting from the rearward region of the muzzle brake may be directed forward and actually impinge on or be contained by the forward deflector 32, and gas pressure venting from the forward region may be directed rearward and impinge on or be contained by the rear deflector 24. For any of these vent configurations the effect of the invention gas deflector is to create a pressure trap which controls the pressure escaping from the apertures, The exact positioning of deflectors 24, 32 on muzzle brake 10 to achieve the greatest improvement in accuracy depends upon many factors, including barrel geometry and stiffness, projectile weight and muzzle velocity, and the amount or type of propellant in the cartridge. Since the interaction of these and other factors cannot be predicted with any degree of accuracy, the shooter must perform trial and error testing to determine the optimum location of the deflectors for a specific set of circumstances. For this reason, deflectors 24, 32 in the illustrated embodiment are attached to muzzle brake 10 by means of set screws 26 so that they may be quickly adjusted by the shooter using a simple and easily carried hand tool such as an Allen wrench.

Although the invention is depicted and described herein as being mounted on a muzzle brake having two axially spaced sets of circular, circumferentially located vent apertures 22, the present invention is compatible and effective with muzzle brakes having any number of different vent aperture shapes and patterns.

Figure 5:
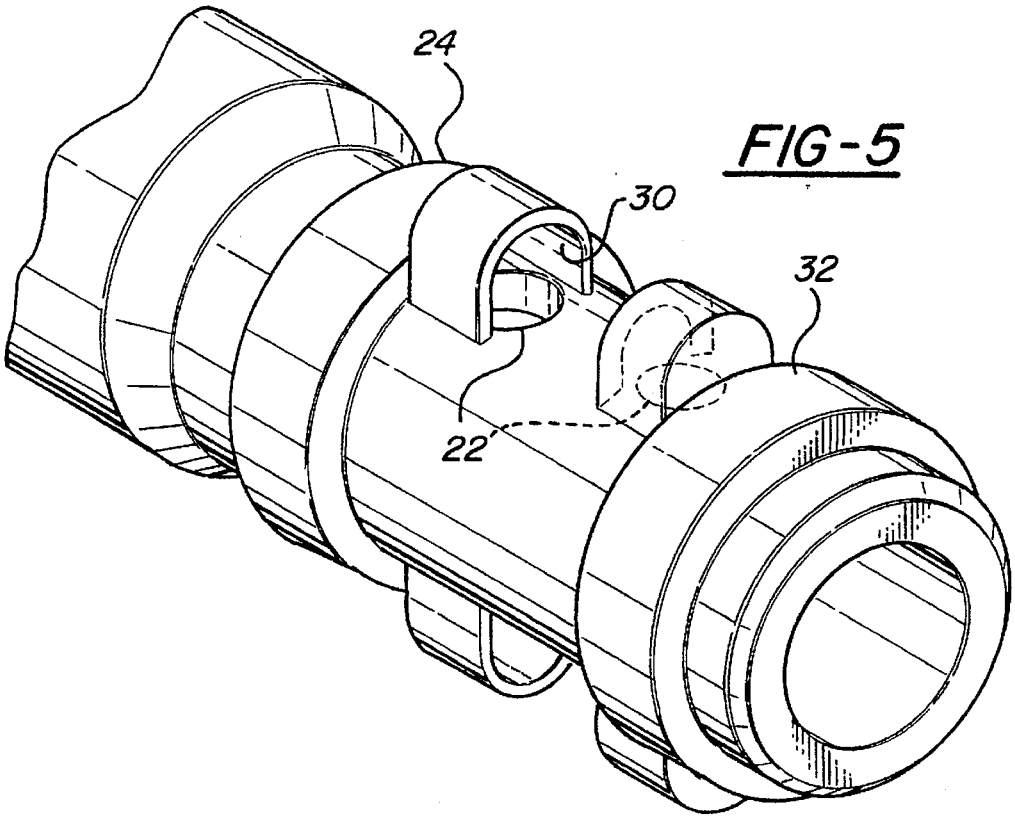
FIG. 5 is an end perspective view of another embodiment of the present invention installed on a muzzle brake having vent apertures located only on the top and bottom of the brake.

Some muzzle brakes, for example, have apertures that are not distributed fully or evenly around the muzzle brake circumference, i.e., located only along limited circumferential portions of the brake, or grouped asymmetrically around the circumference of the brake. Some known examples include apertures located along only an upper section of the brake to reduce muzzle climb. For use with muzzle brakes in which gas pressure is vented from only limited circumferential sections of the brake, a gas pressure deflector system according to the present invention may need not surround the entire circumference of the muzzle brake but rather need only provide deflectors in the vicinity of the vent apertures. For example, FIG. 5 shows an embodiment of the invention for use with a muzzle brake having vent apertures positioned only along the top and bottom on the muzzle brake. However, the full-circumference deflectors of FIGS. 1–4 can also be used with partially-vented muzzle brakes, although they may be slightly less effective.

A preferred embodiment is described herein for use with a firearm such as a rifle. However, it should be noted that the present invention also has utility with most types of projectile launchers including, but not limited to, handguns, shotguns, artillery, rocket launchers, mortars, recoilless rifles, or air guns. The foregoing illustrative embodiment is not intended to limit the invention, but rather to provide an illustrative example within the scope of the following claims.

I claim:

1. An accuracy-improving gas pressure deflector system for use with a firearm muzzle brake, the muzzle brake having rearward and forward ends and including one or more vent apertures defining an elongated region of gas venting, the gas pressure deflector system comprising:

a first rear deflector mounted on an exterior surface of the muzzle brake in association with a rearward portion of the gas venting region for directing gas from the venting region forwardly;

a second front deflector mounted on an exterior surface of the muzzle brake in association with a forward portion of the gas venting region for directing gas from the venting region rearwardly;

the first and second deflectors being mounted on the muzzle brake in a manner permitting adjustable positioning along a longitudinal axis of the muzzle brake in order to adjust the spacing between the first and second deflectors;

the deflectors further being slidingly mounted on the muzzle brake for axial adjustment and detachably secured by set screws which fix the deflectors in place on the muzzle brake when tightened against the muzzle brake to permit sliding movement of the deflectors along the muzzle brake when loosened.

2. The gas pressure deflector of claim 1, wherein the first deflector comprises a substantially frustoconical forward facing gas deflecting surface and the second deflector defines a substantially frustoconical rearward facing gas deflecting surface.

3. The gas pressure deflector of claim 1, wherein the first deflector defines a substantially concave forward facing gas deflecting surface and the second deflector defines a substantially concave rearward facing gas deflecting surface.

4. The gas pressure deflector system of claim 1, wherein the first deflector defines a substantially cylindrical forward facing gas deflecting surface and the second deflector defines a substantially cylindrical rearward facing gas deflecting surface.

5. An accuracy improving gas pressure deflector system for use with a firearm muzzle brake, the muzzle brake having rearward and forward ends and including one or more vent apertures defining an elongated region of gas venting, the gas pressure deflector system comprising:

a first adjustable deflector mounted on an exterior surface of the muzzle brake in association with a rearward portion of the gas venting region and including a deflector surface positioned such that gases venting from the venting region will impinge upon the deflector surface and be redirected forwardly;

a second adjustable deflector mounted on the exterior surface of the muzzle brake in association with a forward portion of the gas venting region and including a deflector surface positioned such that gases venting from the venting region will impinge upon the deflector surface and be redirected rearwardly;

the first and second deflectors being adjustably mounted on the muzzle brake for lengthwise movement and further including means for detachably securing the deflectors to the brake at a desired location to adjust the spacing between the deflectors, the position of the deflectors relative to the firearm barrel, and/or the extent of the gas venting region located between the deflectors.

6. The gas pressure deflector system of claim 5, wherein the first and second deflectors are mounted on the muzzle brake such that the deflector surfaces of the first and second deflectors overlie at least a portion of the gas venting region.

7. The gas pressure deflector system of claim 5, wherein the vent apertures comprise a plurality of axially-spaced apertures, the first deflector being mounted in association with one or more rearward apertures, and the second deflector being associated with one or more forward apertures.

8. The gas pressure deflector system of claim 5, wherein the vent apertures comprise two or more sets of axially-spaced apertures, the first deflector being associated with a rearward set of apertures, and the second deflector being associated with a forward set of apertures.

9. The gas pressure deflector system of claim 5, wherein the vent apertures comprise one or more elongated apertures having a rearward venting portion and a forward venting portion.

10. An accuracy-improving gas pressure deflector system for use with a firearm barrel, comprising:

a substantially tubular muzzle brake having a forward end and a rearward end, and one or more vent apertures defining an elongated gas venting region;

a first axially-adjustable deflector mounted on the muzzle brake, and fastening means for detachably securing the first deflector at a desired location on the muzzle brake;

a second axially-adjustable deflector mounted on the muzzle brake, and fastening means for detachably securing the second deflector at a desired location on the muzzle brake; wherein, the first and second axially-adjustable deflectors each comprise a deflector surface for redirecting gas from the venting region toward the other deflector to define an adjustable length pressure-equalizing trap therebetween to reduce a pressure pulse differential along the muzzle brake.

11. A muzzle brake as defined in claim 10, wherein the first and second deflectors each comprise a sleeve portion having a diameter to mate in a sliding fit over the muzzle brake body.

12. A muzzle brake as defined in claim 10, wherein the deflector surfaces of the first and the second deflectors overlie rearward and forward portions of the gas venting region, respectively.

13. The gas pressure deflector of claim 10, wherein the muzzle brake is formed separately from the firearm barrel and is attached thereto.

14. The gas pressure deflector of claim 13, wherein the muzzle brake is attached to the firearm by means of a set screw.

15. The gas pressure deflector of claim 10, wherein the muzzle brake is formed integrally with the firearm barrel.

16. A muzzle brake as defined in claim 10, wherein the first and second deflectors are independently adjustable along the muzzle brake.

17. The muzzle brake of claim 11, wherein the first and second deflectors are mounted to the muzzle brake by set screws securely fixing the deflectors in place on the muzzle brake when the set screws are tightened and permitting sliding movement of the deflectors along the muzzle brake when the set screws are loosened.

18. The muzzle brake of claim 10, wherein the deflector surface of the first deflector is substantially frustoconical and faces the forward end of the muzzle brake, and the deflector surface of the second deflector is substantially frustoconical and faces the rear end of the muzzle brake.

19. The muzzle brake of claim 10, wherein the deflector surface of the first deflector is substantially concave and faces the forward end of the muzzle brake, and the deflector surface of the second deflector is substantially concave and faces the rear end of the muzzle brake.

20. The muzzle brake of claim 10, wherein the deflector surface of the first deflector is substantially cylindrical and faces the forward end of the muzzle brake, and the deflector surface of the second deflector is substantially cylindrical and faces the rear end of the muzzle brake.

21. The gas pressure deflector system of claim 10, wherein the vent apertures comprise a plurality of axially-spaced apertures, the first deflector being mounted in association with one or more rearward apertures, and the second deflector being associated with one or more forward apertures.

22. The gas pressure deflector system of claim 10, wherein the vent apertures comprise two or more sets of axially-spaced apertures, the first deflector being associated with a rearward set of apertures, and the second deflector being associated with a forward set of apertures.

23. The gas pressure deflector system of claim 10, wherein the vent apertures comprise one or more elongated apertures having a rearward venting portion and a forward venting portion.

* * * * *